United States Patent [19]

Middleton

[11] Patent Number: 5,033,491

[45] Date of Patent: Jul. 23, 1991

[54] CLEANING APPLIANCE FOR PAINT ROLLERS

[76] Inventor: Foster B. Middleton, 202 N. Pinckney St.#103, Madison, Wis. 53703

[21] Appl. No.: 564,644

[22] Filed: Aug. 9, 1990

[51] Int. Cl.[5] ..... B08B 3/02

[52] U.S. Cl. ..... 134/138; 134/900

[58] Field of Search ..... 134/900, 138, 149; 239/567

[56] References Cited

U.S. PATENT DOCUMENTS

| | | | |
|---|---|---|---|
| 3,577,280 | 5/1971 | George | 134/138 |
| 4,606,777 | 8/1986 | Brow | 134/138 X |
| 4,641,673 | 2/1987 | Conley et al. | 134/138 |
| 4,672,987 | 6/1987 | Brandt | 134/138 |
| 4,733,679 | 3/1988 | Dolcater | 134/138 |

*Primary Examiner*—Philip R. Coe
*Attorney, Agent, or Firm*—Keith Schoff

[57] ABSTRACT

A double walled, tubular vessel is configured with a central cavity into which a paint roller can be placed for washing while the roller cover is mounted on a handle frame. A hose fitting is provided to enable connection to be made to a kitchen or bathroom faucet or spigot, or to a pump to provide pressurized water or solvent to the double walled shell manifold from which the liquid sprays through openings in the inner wall into the cavity, impinging on the roller tangentially. The nap of the roller cover is penetrated by the liquid and the roller is caused to spin on its handle resulting in the paint and liquid wash being discharged centrifugally against the wall of the cavity, from which it drains by gravity without mess or splatter into a collecting vessel.

5 Claims, 1 Drawing Sheet

CLEANING APPLIANCE FOR PAINT ROLLERS

BACKGROUND OF INVENTION

Rollers are widely used for applying paint and other surface coatings to flat interior and exterior surfaces of buildings, ships, cement works and other structures.

PRIOR ART

Cleaning of paint rollers for re-use requires rinsing the rollers with suitable solvent, assisted as desired by squeezing, manipulation, or scrapping to wring coating material and solvent from the nap of the rollers. Manual scrappers are known for use in working the nap, but for water based coatings such as acrylic latex paints, a stream of pressurized water directed against a roller is a convenient cleaning method, restricted in its use, however, to areas other than finished living spaces because of the splatter caused by water impinging on a roller.

SUMMARY OF THE INVENTION

A tubular, double walled, vessel is provided for conveniently covering a paint roller while mounted on its handle so that a hose connection can be made from the vessel to the faucet or spigot of a kitchen or bathroom sink or tub to fill the shell between the double walls of the vessel with water under pressure and cause it to be sprayed into the cavity of the vessel into which the roller is inserted. A number of openings are provided in the inner wall of the vessel which direct the water spray issuing from the openings to impinge the roller substantially tangentially to cause it to spin rapidly on its handle and centrifugally throw paint and rinse water outwardly against the enclosing wall of the roller, from which it drains into a collecting vessel without mess or splatter.

DESCRIPTION OF THE INVENTION

Figure 1:
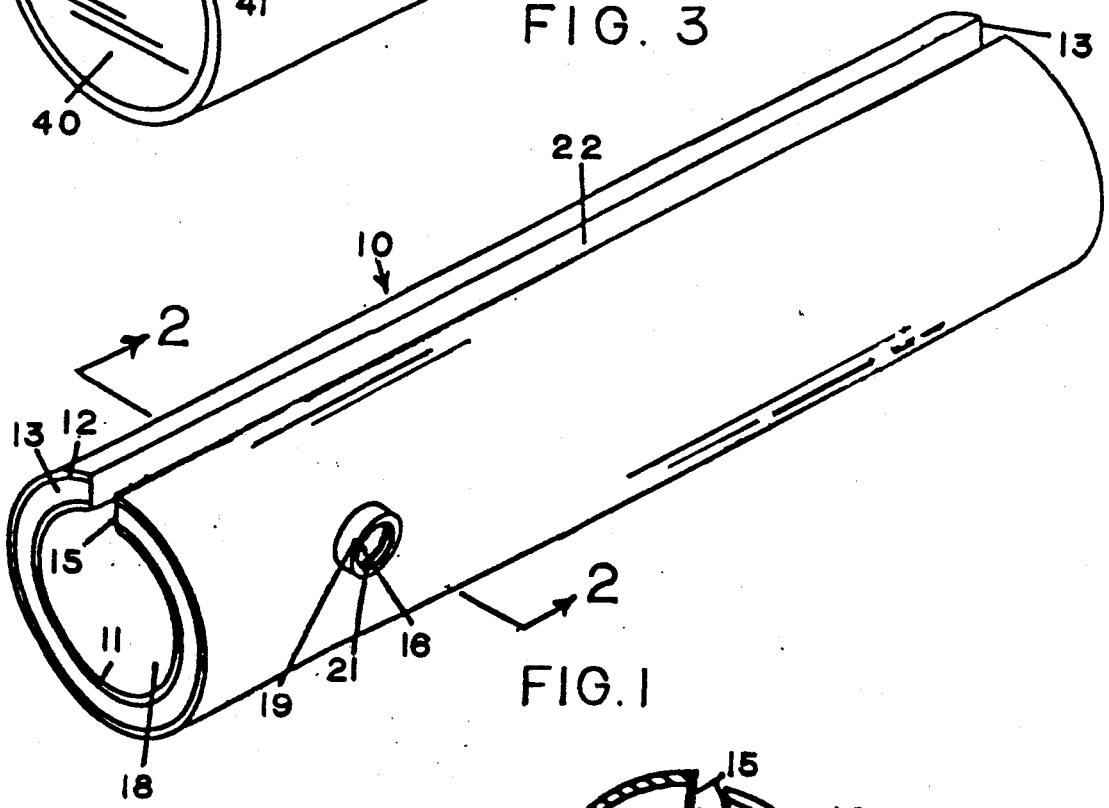
FIG. 1 is a perspective view of one embodiment of a cleaning appliance of this invention.
Figure 2:
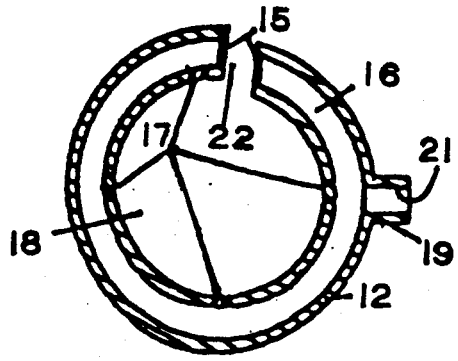
FIG. 2 is a cross-sectional elevation of the embodiment of FIG. 1 taken on cutting plane 2—2 of FIG. 1.

Referring to FIGS. 1 and 2, appliance 10 is configured as a slotted double walled tubular shell with both ends unenclosed. Body member 11 comprises the inner wall of the shell and manifold 12 together with end faces 13 and plates 15 form an enclosed chamber 16. Orifices 17 are distributed in body member 11 communicating chamber 16 with cavity 18 circumferentially throughout the length of body member 11. Hose fitting 19 communicates through manifold 12 operably for receiving a hose coupling. The fitting may be provided with threads 21 internally as shown, or externally as desired. The cross section of appliance 10 as shown is that of a substantially cylindrical annulus interrupted by slot 22 running the length of the appliance. Both ends of cavity 18 are unenclosed as shown, and a paint roller comprising a roller cover mounted on a frame handle may be introduced into appliance 10 from either end of cavity 18 with the handle passing through slot 22. Appliance 10 as shown may be of any operable length and diameter and preferably will be several inches longer than the roller cover to prevent splash and splatter coming from the ends of the appliance while a roller is being cleaned. A maximum length may be about three feet for rollers of two or two and one-half feet in length, to about one foot for seven inch long rollers. As shown, the cross section of appliance 11 is that of a section of a spiral rather than truly circular to inhibit slash and splatter coming through slot 22 during use. However, any other operable cross-section may be provided and slot 22 may be eliminated, if desired, with the roller handle being disposed entirely outside of appliance 10 during use, the handle being axially extending from the end face of a roller cover as assembled. If desired, either of the two ends of cavity 18 may be enclosed to further reduce splatter.

Orifices 17 comprise drilled openings aligned to be axially angular to a tangent to body member 11 at the site of each orifice so as to direct cleaning liquid spraying therethrough to impinge substantially tangential upon the cover of a paint roller operable disposed in cavity 18. The effect of such impingement is to spin the roller on its handle rapidly and centrifugally throw outward paint and cleaning fluid from the nap of a roller cover against body member 11, from which the material drains by gravity into a collection bucket or sink for disposal.

The arrangement of orifices 17 in body member 11 may be in any desired pattern, but preferably the orifices will be relatively uniformly spaced on the inner face of body member 11 with the endmost orifices directed axially somewhat toward the center of cavity 18 for better spraying of the end extremities of the nap face of the roller covers.

Figure 3:
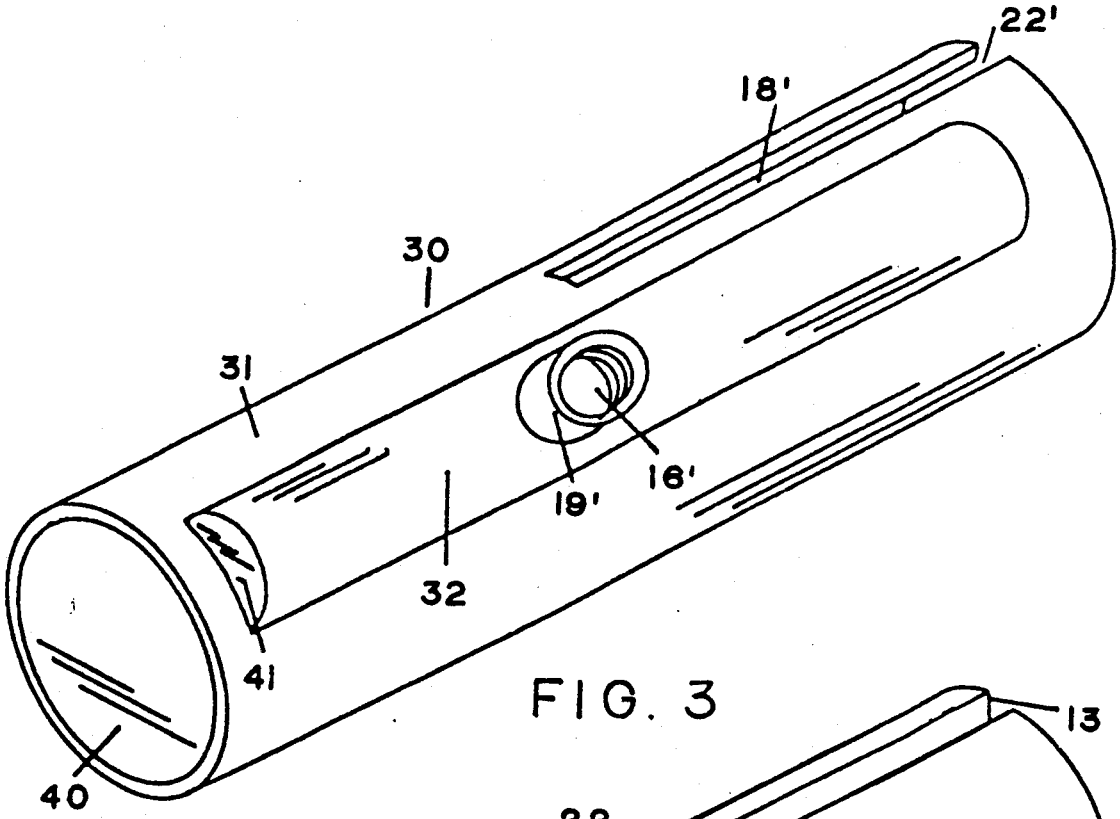
FIG. 3 is a perspective view of another embodiment of the invention.

FIG. 3 discloses appliance 30 comprising cylindrical body member 31 and semi-cylindrical manifold 32 fitted with hose coupling 19'. Slot 22' extends only partially along the length of the appliance and disc 40 closes one end of appliance 30. Similarly, end closures 41 are provided on manifold 32. Orifices similar to orifices 17 of FIG. 2 are hidden from view in FIG. 3, but are arranged communicating chamber 16' within manifold 32 with cavity 18' in the manner of appliance 10.

While the embodiments of invention illustrated are most conveniently used with rollers used to apply water based coatings, such as latex acrylic paint, by connecting the appliance by hose to the faucet or spigot of a kitchen or bathroom sink or tub, it is also possible to clean other coating materials from paint rollers with suitable solvent supplied under pressure by pump means or by displacement by water under pressure from a container. The embodiments of invention are particularly suitable for use by apartment dwellers or others who do not have convenient access to sinks other than those found in their living quarters. The inventive appliances may be of any convenient configuration including square tubular or other polygonal shape, and may conveniently comprise plastic materials of construction such as polyvinylchloride, polystyrene, or polyethylene which do not rust or require coating materials for attractive appearance and to which washed coating material from rollers would poorly adhere. However, other materials such as aluminum or other metal construction may be employed as desired.

I claim:

1. A paint-roller cleaning appliance comprising a) an elongated substantially spiral section tubular body member defining a cavity with at least one unenclosed end capable of accepting a paint roller axially inserted therein with the handle thereof extending radially of said body member through a slot defined by said spiral section, b) a plurality of orifices communicating through said body member aligned to direct liquid passing therethrough to impinge substantially tangentially on a paint roller operably inserted in said body member, c) a manifold disposed externally of said body member and forming therewith a chamber to which said orifices communicate, said manifold further comprising a hose fitting communicating to said chamber, said appliance being operable when connected to a supply of pressurized cleaning liquid furnished through said hose connection and sprayed through said orifices to tangentially impinge on a paint roller disposed in said cavity, causing it to spin and centrifugally expel paint and cleaning liquid from the nap of the roller.

2. The appliance of claim 1 wherein said orifices are disposed along the greater portion of the length of said body member.

3. The appliance of claim 1 wherein manifold is coextensive with said body member.

4. The appliance of claim 1 wherein said body member is configured with one closed end.

5. The appliance of claim 1 wherein said body member is configured with both ends unenclosed.

* * * * *